US006790112B2

(12) United States Patent
Kirk

(10) Patent No.: US 6,790,112 B2
(45) Date of Patent: Sep. 14, 2004

(54) RECREATIONAL FLOATATION DEVICE WITH INTEGRAL CUP HOLDER

(75) Inventor: Donald P. Kirk, Olathe, KS (US)

(73) Assignee: Captain Noodle, Inc., Olathe, KS (US)

( * ) Notice: Subject to any disclaimer, the term of this patent is extended or adjusted under 35 U.S.C. 154(b) by 0 days.

(21) Appl. No.: 10/248,457

(22) Filed: Jan. 21, 2003

(65) Prior Publication Data

US 2004/0142614 A1 Jul. 22, 2004

(51) Int. Cl.[7] ..... B63C 9/08
(52) U.S. Cl. ..... 441/129; 220/739; 220/903
(58) Field of Search ..... 441/129, 130, 441/131, 132; 62/457.5; 472/128, 129; D7/608, 624.2, 624.3, 619.1, 619.2; 220/560, 739, 902, 903; D21/803

(56) References Cited

U.S. PATENT DOCUMENTS

| | | | | | |
|---|---|---|---|---|---|
| 205,617 | A | | 7/1878 | D'Alessandro | |
| 3,161,897 | A | * | 12/1964 | Hill | 441/130 |
| 3,324,488 | A | | 6/1967 | Schultz | |
| 4,115,888 | A | * | 9/1978 | Sievers | 440/38 |
| 4,516,409 | A | * | 5/1985 | Hobbs et al. | 220/902 |
| 4,721,216 | A | | 1/1988 | Kinder | |
| 5,004,296 | A | * | 4/1991 | Ziegenfuss, Jr. | 441/132 |
| 5,211,307 | A | * | 5/1993 | Jeffries | 220/739 |
| 5,261,554 | A | * | 11/1993 | Forbes | 220/739 |
| 5,277,733 | A | * | 1/1994 | Effertz | 156/215 |
| 5,292,273 | A | | 3/1994 | Giessl | |
| 5,476,404 | A | | 12/1995 | Price | |
| 5,520,561 | A | | 5/1996 | Langenohl | |
| 5,727,709 | A | * | 3/1998 | Nobile | 220/560 |
| 5,740,940 | A | * | 4/1998 | Weiss | 220/739 |
| 5,758,513 | A | * | 6/1998 | Smith | 62/457.5 |
| 5,897,409 | A | * | 4/1999 | Hartman et al. | 441/129 |
| 5,947,782 | A | | 9/1999 | Siladke et al. | |
| 5,971,823 | A | | 10/1999 | Sanso | |
| 6,027,393 | A | | 2/2000 | O'Rourke | |
| 6,206,223 | B1 | * | 3/2001 | Wicker | 220/739 |
| 6,247,935 | B1 | * | 6/2001 | Martin et al. | 434/254 |
| 6,276,979 | B1 | | 8/2001 | Saltel et al. | |
| 6,312,630 | B1 | | 11/2001 | Hartman | |
| 6,401,382 | B2 | * | 6/2002 | Larkin | 43/43.11 |
| 6,494,339 | B1 | * | 12/2002 | Engelhard et al. | 220/739 |
| 6,497,919 | B1 | | 12/2002 | Hartman | |

OTHER PUBLICATIONS

U.S. patent application Publication No. US 2001/00492240 entitled Personal Flotation Device Apparatus with Hand–Held Tool. Pub. Date: Dec. 6, 2001.

* cited by examiner

*Primary Examiner*—S. Joseph Morano
*Assistant Examiner*—Andrew Wright
(74) *Attorney, Agent, or Firm*—Hovey Williams LLP

(57) ABSTRACT

A recreational flotation device (10) is provided which is designed to support a user (S) floating in water while affording a convenient holder for beverage containers. The device (10) comprises an elongated body (12) formed of synthetic resin material and having a density such that the body will float in water (e.g., extruded polyethylene). The body (12) presents a pair of opposed butt ends (14, 16), with at least one of the butt ends (14,16) being recessed to define a receptacle (18) integral with the body (12) for receiving a beverage container (24) therein. A preferred alternative device (110) is provided wherein the body (112) includes a pair of differently dimensioned receptacles (118,120) respectively located at the ends (114, 116) and integrally formed with the body (112).

11 Claims, 2 Drawing Sheets

RECREATIONAL FLOATATION DEVICE WITH INTEGRAL CUP HOLDER

BACKGROUND OF INVENTION

1. Field of the Invention

The present invention is broadly concerned with recreational flotation devices commonly used by swimmers and bathers in pools, lakes and oceans. More particularly, the invention is concerned with such devices which are formed as integral bodies from a suitable low-density synthetic resin material so that the bodies will float and including at least one receptacle integrally formed in a butt end of the bodies for receipt of a beverage container such as a can or bottle.

2. Description of the Prior Art

Recreational flotation devices have long been available for the enjoyment of water sport enthusiasts. For example, U.S. Pat. No. 5,520,561 describes a pool float of generally U-shaped configuration supporting central netting. This reference suggests that upright beverage holders be attached as add-on accessories. Other types of flotation devices are disclosed in U.S. Pat. Nos. 5,947,782, 5,971,823, 6,276,979, 5,476,404, 3,324,488, 4,721,216, and 205,617.

Notwithstanding the diversity of prior flotation devices, none have heretofore been designed both for flotation and with the provision of integrally formed endmost beverage container receptacles allowing the user to have ready access to a drink.

SUMMARY OF INVENTION

The present invention overcomes the problems outlined above and provides an improved recreational flotation device and comprising an elongated body formed of synthetic resin material having a density such that the body will float in water. The body also presents a pair of opposed butt ends with at least one of the butt ends being recessed to define a receptacle integral with the body for receiving a beverage container therein.

In preferred forms, the body is formed of a cellular synthetic resin material such as extruded polyethylene that is both yieldable and shape-retaining. Other suitable materials include polyurethanes and polycarbonates. Moreover, preferred devices of the invention are equipped with differently configured beverage container-receiving recesses adjacent the respective butt ends thereof. This would permit a single device to accommodate, for example, both a standard aluminum beverage can and/or an upright glass, or plastic bottle for storing water, soda, beer or the like.

The devices of the invention can be of any virtually desired size or shape as dictated by desired end usage. In one preferred embodiment, the device is an extruded polyethylene body which is generally arcuate or U-shape in configuration, with each butt end of the body being recessed to define integral, differently dimensioned beverage container receptacles configured to securely receive at least two differently dimensioned beverage containers having dimensions commonly utilized in the beverage industry.

DETAILED DESCRIPTION

Figures 1, 2, 4:
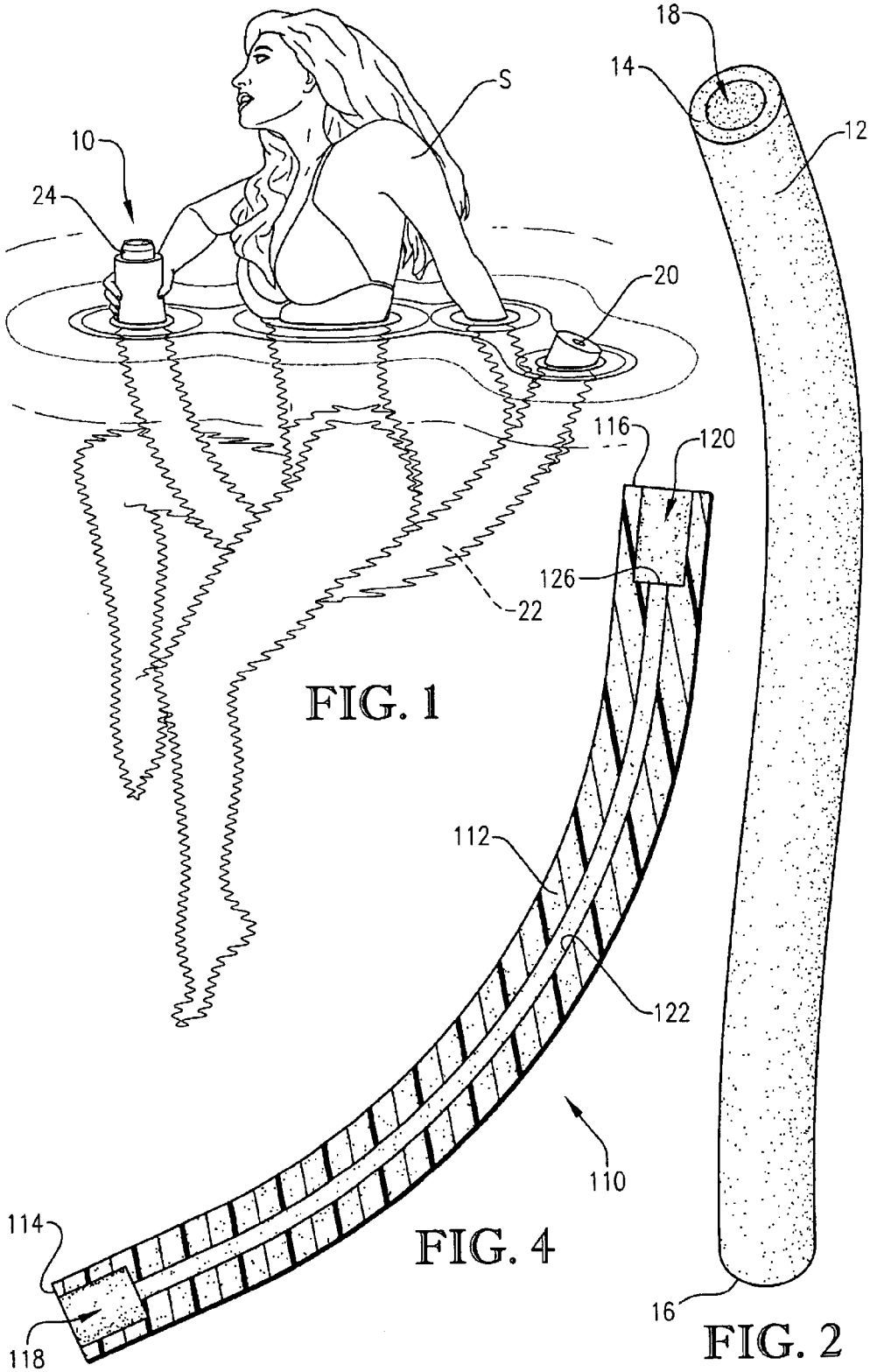
FIG. 1 is an elevational view of a recreational floatation device constructed in accordance with a preferred embodiment of the present invention including a recessed beverage container receptacle integrally formed in one end and shown in a typical use by a user.
FIG. 2 is an elevational view of the device illustrated in FIG. 1.
FIG. 4 is a sectional view of a recreational floatation device constructed in accordance with a preferred alternative embodiment of the present invention including differently dimensioned recessed beverage container receptacles integrally formed in both ends.

FIG. 1 illustrates a recreational floatation device 10 constructed in accordance with the principles of a preferred embodiment of the present invention and configured for supporting a user in the water. For example, the device 10 as illustrated in FIG. 1 is shown supporting an adult swimmer S partially submerged in a body of water (e.g., a pool, a lake, an ocean, etc.). For reasons that will subsequently become apparent, the device 10 is configured to support at least a portion of the swimmer S above the water line while still allowing at least one end of the device 10 to extend above the water line for supporting a beverage container therein. Except as indicated below, the principles of the present invention are not limited to a particular shaped floatation device nor any particular use thereof and equally apply to most personal floatation devices and virtually any traditional uses thereof. The illustrated device 10 includes an integral body 12 presenting a pair of opposed butt ends 14 and 16 and defining a receptacle 18 integral with the end 14 of the body 12 and configured for receiving a conventional beverage container (e.g., a can or a bottle) therein (see FIGS. 1 and 2).

As shown in FIGS. 1 and 2, the illustrated body 12 is an elongated body presenting a substantially cylindrical shape. The body 12 is tubular and provides a continuous, central passageway 20 extending substantially the full length of the body 12 and communicating with the receptacle 18 and the opposite end 16 (see FIGS. 1 and 3).

The body 12 is configured to support the swimmer S at least partially above the water line. In this regard, the body 12 preferably presents an outer diameter (i.e., a maximum cross-sectional dimension) ranging from about two and one-half to twelve inches, more preferably from about three and one-half to six inches, and most preferably around four inches. The passageway 20 presents a diameter of preferably less than about two inches and more preferably less than about one inch. The overall length of the body 12 is likewise variable and preferably ranges from twelve to seventy-two inches, and more preferably from about thirty-six to sixty inches.

As previously indicated, the body 12 is configured to support the swimmer S at least partially above the water line. In this regard, the body 12 is preferably fabricated from a suitable synthetic resin material, such as extruded cellular polyethylene, having a density such that the body will float in water. The synthetic resin material preferably has a density from about 1.5–2.5 pounds per cubic foot and more preferably from about 1.8–2.0 pounds per cubic foot. In addition, the material from which the body 12 is fabricated is preferably both yieldable and shape-retaining. In this manner, the body 12 may be substantially straight or gently arcuate as shown in FIG. 2, or may be yielded to have a more pronounced arcuate shape as shown in FIG. 1, such that the body 12 presents an arcuate intermediate bight section 22 between the butt ends 14,16 thereof.

It is within the ambit of the present invention to utilize variously configured sizes, shapes and materials for the body of the recreational floatation device. For example, virtually any cross-sectional configuration, such as square, triangular or polygonal, can be employed for the body. However, it is important that the body be operable to support a user at least partially submerged in water.

Figure 3:
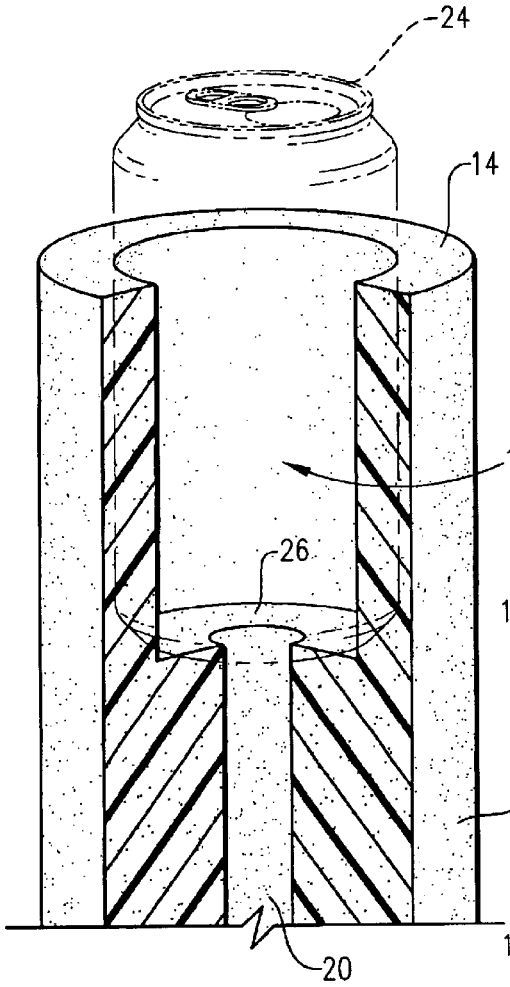
FIG. 3 is an enlarged, fragmentary, vertical sectional view of the device illustrated in FIGS. 1 and 2 and illustrating the recessed beverage container receptacle integrally formed in one end and shown with a conventional beverage can (shown in phantom) received within the recessed receptacle.

As previously indicated, the receptacle 18, integrally formed in the end 14 of the body 12, is configured for receiving a conventional beverage container (e.g., a can or a bottle) therein. In more detail, and as shown in FIG. 3, the illustrated receptacle 18 is designed so as to frictionally receive, and maintain in position, a standard beverage can 24, such as a metal, twelve ounce container for soda or beer, or a similarly configured plastic container for water. In this regard, the receptacle 18 defines a central bore extending only partially into the end 14 and having a diameter greater than the diameter of the central passageway 20. In this manner, the receptacle 18 presents a ledge 26 recessed in the body 12. The diameter of the receptacle 18 is preferably configured to frictionally engage the can 24 received therein to generally prevent the can 24 from inadvertent or accidental removal therefrom. The diameter of the receptacle 18 is preferably about two and one-half inches and more preferably 2.6 inches. The ledge 26 is preferably sufficiently recessed within the body 12 to support the can 24 mostly within the body 12 while allowing a portion of the can 24 to protrude out of the end 14 to enable the swimmer S to comfortably remove the can 24 from the body 12 without spilling the contents from the can 24. In this regard, the ledge 26 is preferably recessed into the body 12 from three to four inches, and more preferably about three and one-half inches. It is within the ambit of the present invention to utilize various alternative configurations for the receptacle 18. For example, the receptacle could be sized and configured to retainingly receive other standard beverage containers other than the conventional twelve ounce metal can (e.g., plastic or glass bottles, etc.). Additionally, the body could include identical or differing receptacles formed in each end. However, it is important that the receptacle be integrally formed in the body of the device. In this manner, the device is easily and cost-effectively manufactured while providing the user with ready access to the beverage container received therein.

Returning now to FIG. 1, the device 10 is depicted in a typical use in accordance with the invention. As shown, the beverage can 24 is received within the butt end 14 for ready removal. In this instance, the swimmer S grasps the body 12 adjacent the ends 14, 16 with the bight section 22 passing between the swimmer's legs. It will be appreciated that the device 10 provides for personal recreational floatation while enabling the swimmer S to have constant and ready access to a refreshing beverage as is often desired when recreating in and around the water. It will be appreciated, that the device 10 can be used in various alternative manners (e.g., the bight section 22 positioned under both legs of the swimmer S rather than between them so that the ends 14,16 extend upwards adjacent each side of the swimmer S, etc.). Additionally, alternative shapes for the body may dictate additional or different particular modes of use.

As previously indicated, it is within the ambit of the present invention to utilize various alternative configurations for the recreational floatation device. One such suitable alternative is the recreational floatation device 110 illustrated in FIGS. 4 and 5. The device 110 is similar in many respects to the previously described device 10 as detailed above and includes an elongated body 112, formed of the synthetic resin material described previously, and presenting opposed butt ends 114 and 116. However, unlike the device 10, the device 110 includes beverage container receptacles 118 and 120 integrally formed in each of the corresponding ends 114,116, respectively. The body 112 further includes a continuous central passageway 122 extending substantially the full length of the body 112 and communicating with the endmost receptacles 118,120. The receptacle 118 is virtually identical to the previously described receptacle 18 and thus will not be further described.

Figure 5:
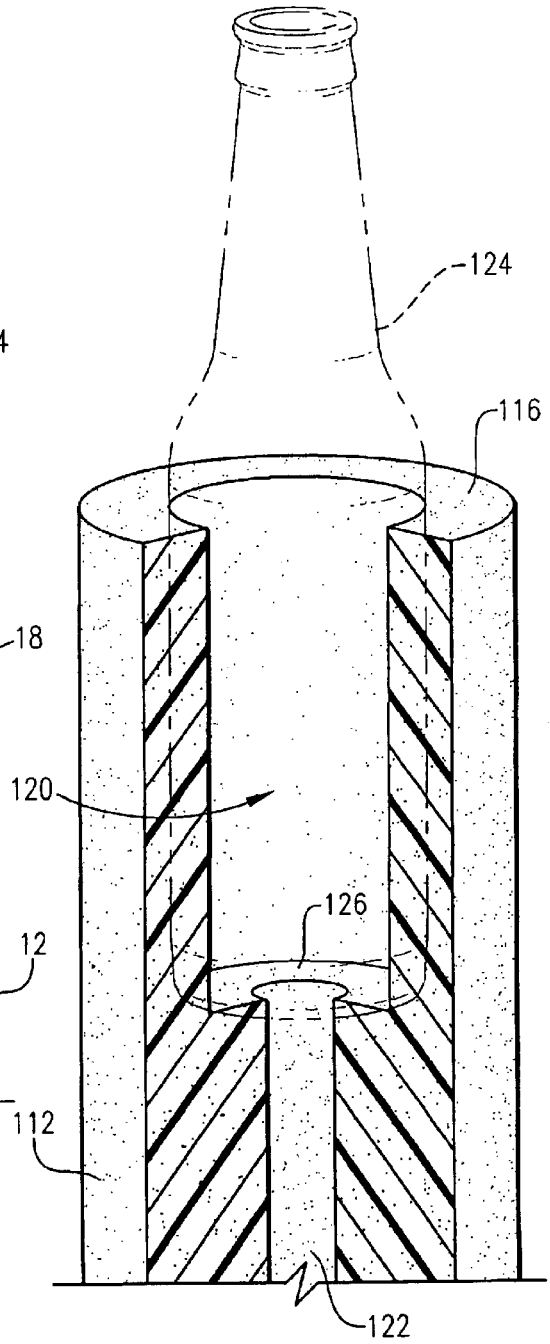
FIG. 5 is an enlarged, fragmentary vertical sectional view illustrating one of the integrally formed recessed beverage container receptacles and shown with a conventional beverage bottle (shown in phantom) received therein.

Turning to FIG. 5, the illustrated receptacle 120, differs from the receptacle 118 and presents a smaller diameter and a greater length that is designed to frictionally receive and maintain a standard beverage bottle 124, such as a glass, twelve ounce long-neck-type soda or beer container or a similarly configured plastic bottle for water. In this regard, the receptacle 120 defines a central bore extending only partially into the end 116 and having a diameter greater than the diameter of the central passageway 122. In this manner, the receptacle 120 presents a ledge 126 recessed in the body 112. The diameter of the receptacle 120 is preferably configured to frictionally engage the bottle 124 received therein to generally prevent the bottle 124 from inadvertent or accidental removal therefrom. The diameter of the receptacle 120 is preferably less than two and one-half inches and more preferably about 2.35 inches. The ledge 126 is preferably sufficiently recessed within the body 112 to support the bottle 124 partly within the body 112 while allowing a portion of the bottle 124 to protrude out of the end 116 to enable the user to comfortably remove the bottle 124 from the body 112 without spilling the contents from the bottle 124. In this regard, the ledge 126 is preferably recessed into the body 112 from four to five inches, and more preferably about four and one-half inches. The multiple, differing receptacles 118,120 of the device 110 enable the device 110 to be used to store a variety of varying beverage containers when in use by the user. For example, if the user desires to store a standard beverage can (such as the can 24 described above) the user simply inserts the can into the end 114. If, however, the user desires to store a standard beverage bottle, such as the bottle 124, the user simply inserts the bottle 124 into the end 116.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A combination comprising:

a recreational device comprising an elongated body formed of synthetic resin material and having a density such that the body will float in water, said body presenting a pair of opposed butt ends, at least one of said butt ends being recessed to define a receptacle integral with the body; and a beverage container received within said receptacle, said body being generally arcuate and presenting a bight section intermediate said butt ends, there being respective recesses in each of said butt ends to define individual receptacles integral with the body, there being an individual beverage container within each of said receptacles.

2. The combination of claim 1, said body formed of polyethylene material.

3. The combination of claim 2, said body being formed by extrusion of said polyethylene material.

4. The combination of claim 2, said polyethylene material having a density of from about 1.5–2.5 pounds per cubic foot.

5. The combination of claim 4, said density being from about 1.8–2.0 pounds per cubic foot.

6. The combination of claim 1, the size of said receptacles being different for receiving different types of beverage containers.

7. The combination of claim 6, one of said receptacles being configured for receiving a metal, twelve ounce beverage can, and the other of said receptacles being configured for receiving a twelve ounce long-neck beverage bottle.

8. The combination of claim 7, said one of said receptacles presenting a diameter of more than two and one-half inches, said other of said receptacles presenting a diameter of less than two and one-half inches.

9. The combination of claim 8, said one of said receptacles defining a first ledge and said other of said receptacle defining a second ledge, said first ledge being recessed relative to said at least one of said butt ends about three and one-half inches, said second ledge being recessed relative to the other butt end about four and one-half inches.

10. The device of claim 1, including an elongated central passageway extending along the length of said body and communicating with said receptacles.

11. The combination of claim 1, said pair of opposed butt ends being spaced between about thirty-six and about sixty inches.

* * * * *